US010183796B2

(12) United States Patent
Kruse et al.

(10) Patent No.: US 10,183,796 B2
(45) Date of Patent: Jan. 22, 2019

(54) SIDE-GUSSET BAG AND METHOD OF MAKING A SIDE-GUSSET BAG

(71) Applicant: MONDI Consumer Packaging Technologies GmbH, Gronau (DE)

(72) Inventors: Alfons Kruse, Dinklage (DE); Detlef Stoeppelmann, Steinfeld (DE); Jens Koesters, Wallenhorst (DE)

(73) Assignee: MONDI CONSUMER PACKAGING TECHNOLOGIES GMBH, Gronau (DE)

( * ) Notice: Subject to any disclaimer, the term of this patent is extended or adjusted under 35 U.S.C. 154(b) by 92 days.

(21) Appl. No.: 14/941,734

(22) Filed: Nov. 16, 2015

(65) Prior Publication Data

US 2016/0137378 A1 May 19, 2016

(30) Foreign Application Priority Data

Nov. 18, 2014 (DE) ..... 10 2014 116 820

(51) Int. Cl.

| | |
|---|---|
| ***B65D 75/58*** | (2006.01) |
| ***B65D 75/00*** | (2006.01) |
| ***B65D 30/20*** | (2006.01) |
| ***B65D 33/25*** | (2006.01) |
| ***B31B 70/00*** | (2017.01) |

(Continued)

(52) U.S. Cl.

CPC ..... *B65D 75/5866* (2013.01); *B31B 70/00* (2017.08); *B65D 31/10* (2013.01); *B65D 33/2508* (2013.01); *B65D 75/008* (2013.01); *B31B 2155/00* (2017.08); *B31B 2160/20* (2017.08); *B65D 2575/586* (2013.01)

(58) Field of Classification Search

CPC ..... B31B 2237/20; B31B 37/00; B31B 19/86; B31B 2219/9077; B31B 19/90; B65D 75/5866; B65D 31/10; B65D 33/2508; B65D 75/008; B65D 2575/586

USPC ..... 493/226

See application file for complete search history.

(56) References Cited

U.S. PATENT DOCUMENTS

| | | | | |
|---|---|---|---|---|
| 4,055,109 A * | 10/1977 | Kan | B31B 37/00 493/196 |
| 5,547,284 A * | 8/1996 | Imer | B31B 37/00 383/104 |
| 6,971,794 B2 | 12/2005 | Yeager | |

(Continued)

FOREIGN PATENT DOCUMENTS

| | | |
|---|---|---|
| DE | 102008021505 A | 11/2009 |
| EP | 2032454 A | 1/2013 |

*Primary Examiner* — Sameh Tawfik

(74) *Attorney, Agent, or Firm* — Andrew Wilford

(57) ABSTRACT

A bag has front and back face panels having upright longitudinally extending side edges and transversely extending upper and lower edges. First and second gusset panels each have transversely extending upper and lower edges and upright longitudinal outer edges connected to the longitudinal edges of the face panels. A reclosable fastener strip extends continuously and transversely along the first gusset panel and inward along each of the face panels from the first gusset panel along part of a transverse width of the face panels. Thus opening of the fastener and folding out of the first gusset panel forms a spout on the bag. A separate generally rectangular floor panel is joined at its outer edge by thermal welds to the lower edges of the face panels and of the gusset panels.

11 Claims, 6 Drawing Sheets

(51) Int. Cl.
*B31B 155/00* (2017.01)
*B31B 160/20* (2017.01)

(56) References Cited

U.S. PATENT DOCUMENTS

| | | | | |
|---|---|---|---|---|
| 7,331,917 | B2 | 2/2008 | Totani | |
| 7,506,487 | B2 * | 3/2009 | Eads | B31B 19/36 383/203 |
| 8,182,407 | B2 | 5/2012 | Yeager | |
| 8,414,465 | B2 * | 4/2013 | Totani | B31B 37/00 493/162 |
| 8,430,566 | B2 * | 4/2013 | Brauer | B65D 33/08 383/109 |
| 8,579,780 | B2 * | 11/2013 | Senbo | B31B 1/64 493/189 |
| 2004/0208402 | A1 * | 10/2004 | Yeager | B31B 19/36 383/120 |
| 2011/0033133 | A1 * | 2/2011 | Kujat | B65D 31/10 383/20 |
| 2011/0206300 | A1 * | 8/2011 | Koesters | B31B 23/00 383/10 |

* cited by examiner

Fig. 3E
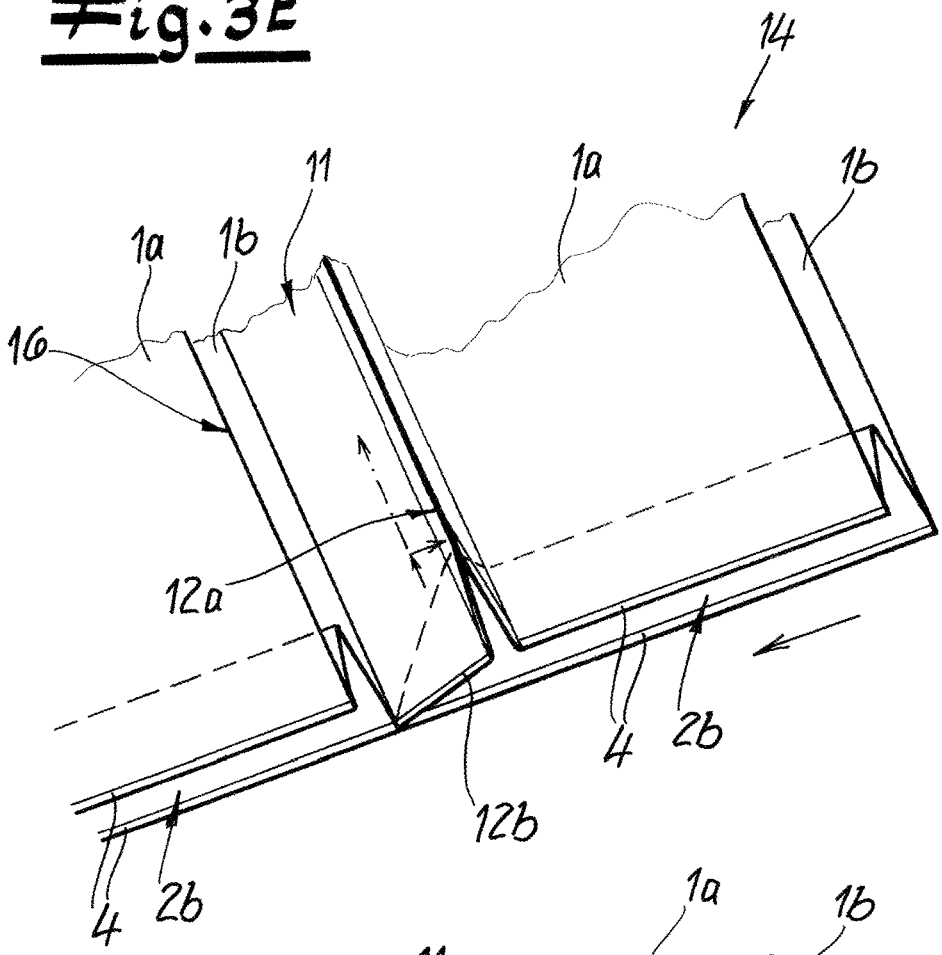
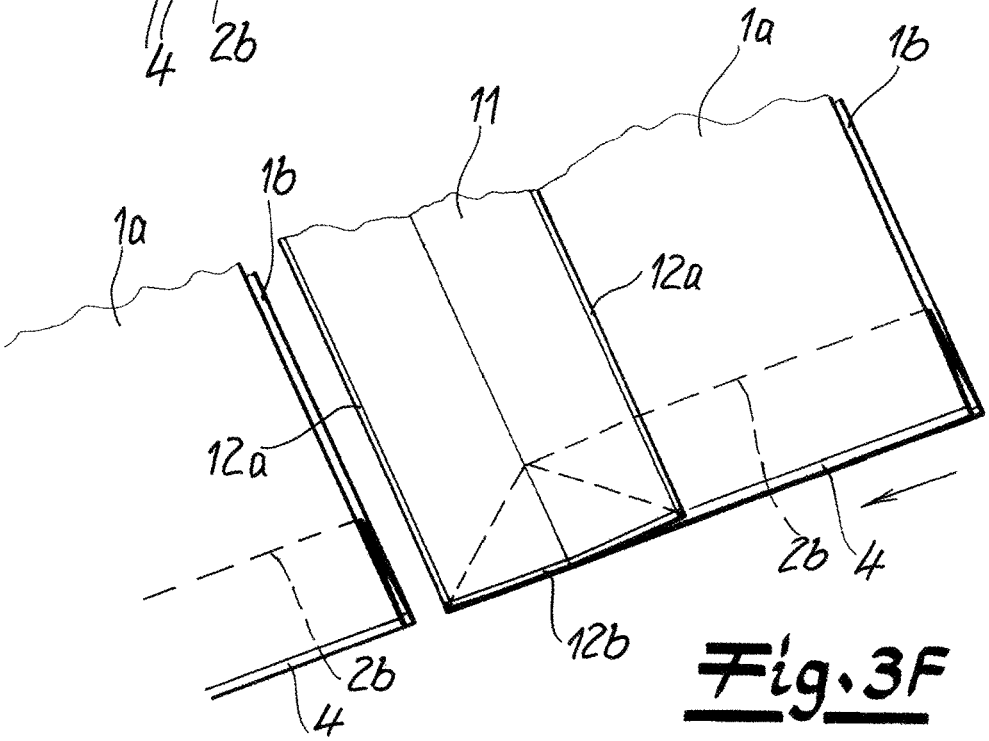
Fig. 3F

SIDE-GUSSET BAG AND METHOD OF MAKING A SIDE-GUSSET BAG

FIELD OF THE INVENTION

The present invention relates to a side-gusset bag. More particularly this invention concerns a method making such a bag.

BACKGROUND OF THE INVENTION

A typical side-gusset bag has two opposite front and back face panels, a first and a second side gusset panel that extend opposite one another in a longitudinal direction and that connect respective longitudinally extending side edges of the front and back face panels to one another, a reclosable fastener that has at least one reclosable fastener strip and is provided at the first side gusset panel and extends transversely of the bag only over a portion of the width of the face panels and enables the first side gusset panel to be folded out to form a reclosable spout. See U.S. Pat. No. 6,971,794, U.S. Pat. No. 8,182,4070, EP 2 032 454 and US 2011/0033133.

Usually, the side-gusset bag is formed from a plastic film, in particular a multi-layered laminated film that has a thermally weldable inner layer forming an inner surface of the side-gusset bag and an outer layer forming an outer surface of the side-gusset bag. Such a laminated film can carry an inner imprint that is done before laminating.

One of the two side gusset panels is provided with the reclosable fastener. When folded in, it fixes and closes the respective side gusset panel between the face panels. When opened and folded out, it forms a spout. When the side-gusset bag is filled, a transversely extending upper weld is provided above the reclosable fastener, which upper weld has first to be torn off, cut off or peeled open in certain sections at a corresponding upper section for the first opening.

The side-gusset bags known from the prior art have a reclosable fastener with a single reclosable fastener strip that can be interlocked with itself and that extends on the inside of the bag at a side gusset panel and, adjacent the gusset panel, it extends also on the front and back face panels and connects the side gusset panel with the front and back face panels. Thus, extending from a center line of the side gusset panel, a subpanel formed by one half of the side gusset panel is connected to the first face panel and the other half of the side gusset panel is connected to the second face panel.

According to the prior art, the length of the reclosable fastener strip on the front and back face panels can be different. In particular, the reclosable fastener strip on the face panels can also extend beyond the corresponding side gusset panel so that the front and back face panels are then directly connected to one another adjacent the side gusset panel, thereby providing a larger removal opening. However, the reclosable fastener always extends only over a portion of the entire transverse width of the face panels. Advantageously, a connection line, in particular a thermal weld, running either in the longitudinal direction or the transverse direction of the bag can also be provided adjacent the reclosable fastener strip in order to limit the opening.

Various methods of making side-gusset bags are known in practice. The prior-art side-gusset bags having a reclosable fastener at only one side gusset panel and the associated sections of the face panels are formed from a single film web by folding. The reclosable fastener strip that can be interlocked with itself is placed onto the flat-lying material web, and then one of the side gusset panels is formed at the reclosable fastener strip. From a side-gusset tube having face panels and gusset panel-forming side walls, individual side-gusset bags or corresponding blanks are then cut, each of them having a reclosable fastener strip.

Since the production direction of the material web or the side-gusset tube corresponds to the longitudinal direction of the side gusset panels, the corresponding methods are also designated as "longitudinal methods."

Individual side-gusset bags are thus cut from the side gusset panel tube, and filling can take place immediately according to the so-called FFS (Form Fill and Seal) method. As an alternative, it is also possible to first make prefabricated side-gusset bags that are open at at least at one end and, for the time being, can be stored and delivered to a packaging site. Such side-gusset bags are then filled and sealed separately.

Also known from practice are alternative production methods in which the face panels and the side gusset panels are formed from separate film sections. For example, U.S. Pat. No. 7,331,191 describes a method of making film packaging bags in which a bag sheet is formed in such a manner that successive film packaging bags are arranged with their longitudinal bag edges positioned next to one another. Thus, the production direction extends transversely to the bags, which is why such a method is also designated as "transverse method" or as "Totani method."

According to U.S. Pat. No. 7,331,191, first, a bag sheet of successive connected bag blanks is formed. A first film web is conveyed in the production direction. Subsequently, a film strip is fed in, and the edges of the film strip are folded over on a middle section. Usually, the edges have the same width so that a gap still remains after folding. Subsequently, pieces of the film strips are placed equally spaced apart from one another transverse to the production direction (thus, along the longitudinal bag direction) onto the first film web before a second film web is fed in the production direction so that the first film web and the pieces of the film strips are covered. Then, longitudinal welds are produced transverse to the production direction, so that on the one hand the film strips are welded to the second film web at the folded edges and on the other hand are welded to the first film web on an opposite side. The bag sheet formed in this way, finally, is cut into individual film packaging bags by cuts such that two side gusset panels of successive side-gusset bags are formed from a folded film strip. In addition to the side gusset panels, a separate bottom gusset panel as a flat bottom can also be produced.

With such a transverse method it is readily possible to make the side gusset panels shorter than the front and back face panels so that a continuous reclosable fastener that only connects the front and back face panels to one another can be provided above the side gusset panels. However, the provision of a reclosable fastener in region of one of the side gusset panel that allows folding out of the corresponding side gusset panel into a spout is not practical with the described transverse method because separate pieces of film are needed for forming the front and back face panels and the side gusset panels and subsequently have to be connected and then it is not possible to mount a reclosable fastener on one of the side gusset panels and the associated sections of the face panels with usual technical means.

In order to produce a bottom floor panel for the prior-art side-gusset bags having a reclosable fastener on a side gusset panel, a lower edge of the side-gusset bag can be closed with a transverse weld, and then, however, uniform placement of the side-gusset bag is not possible. Rather, such a side-gusset bag has a tendency to tilt to the side during filling, transportation or storage when the side-gusset is to be placed down with its lower section as the bottom.

In order to reduce this tendency to tilt over, it is known to first close a lower section of the side-gusset bag with a transverse weld and then fold it onto itself so that a kind of a reinforced double-wall bottom is formed. However, this approach is disadvantageous due to the fact that it requires an additional step for folding, and folding the lower section onto itself also results in increased material requirements. Finally, by folding the end section in one direction, a certain asymmetry remains so that an inclined position cannot be avoided completely. Also, producing additional corner welds or the like cannot entirely solve the described problem.

OBJECTS OF THE INVENTION

It is therefore an object of the present invention to provide an improved side-gusset bag.

Another object is the provision of such an improved side-gusset bag that overcomes the above-given disadvantages, in particular that has a reclosable fastener on a side gusset panel that can be folded out and that has improved tilting stability.

A further object is to provide an improved a method of making such a side-gusset bag.

SUMMARY OF THE INVENTION

A bag has according to the invention front and back face panels having upright longitudinally extending side edges and transversely extending upper and lower edges. First and second gusset panels each have transversely extending upper and lower edges and upright longitudinal outer edges connected to the longitudinal edges of the face panels. A reclosable fastener strip extends continuously and transversely along the first gusset panel and inward along each of the face panels from the first gusset panel along part of a transverse width of the face panels. Thus opening of the fastener and folding out of the first gusset panel forms a spout on the bag. A separate generally rectangular floor panel is joined at its outer edge by thermal welds to the lower edges of the face panels and of the gusset panels.

By providing a reclosable fastener on a side gusset panel while forming on the one hand an outwardly foldable spout and on the other hand a flat bottom in the form of a separate film section, according to the invention, particularly advantageous measures are combined that, according to the prior art, could only be implemented through different bag production methods and thus could not be combined.

The method according to the invention comprises first advancing a longitudinally elongated bag film having longitudinal edges in a production direction and forming a succession of longitudinally spaced cuts each extending transversely across more than one longitudinally extending half of the bag web from a point spaced transversely inward of one longitudinal edge of the bag film and each having a length equal to a transverse width of the front panel plus twice a rectified transverse width of one of the side gusset panels. This bag film is then folded along longitudinal fold lines with the one longitudinally extending half on top and with the longitudinal edges lying generally atop one another to form a bag tube having a longitudinal succession of the back panels, a longitudinal succession of the front panels lying atop the back panels and separated by the cuts, and two longitudinal successions of side gusset panels folded between the longitudinal edges of the face panels and also separated by the cuts. Then the lower edge of each of the front panels is lifted at the cut and a respective rectangular film section is fitted to each of the lifted lower edges to form the floor panel that is then joined to the lower edges of the front and back panels and of the side panels. The uncut longitudinal edges of the bag web are trimmed off and the cut, folded, and welded bag film is then separated into individual bags at the cuts.

Thus, based on the known longitudinal method, a refinement is provided with which it is also possible to attach a separate film section as a flat bottom for each side-gusset bag.

The side-gusset bag according to the invention is characterized by being particularly easy to handle and use. The reclosable fastener on the first side gusset panel allows the bag to be closed after the first opening in a folded-in state in which the two subpanels of the first side gusset panel are each attached to one of the front and back face panels. By opening the reclosable fastener, the side gusset panel can then be folded outward to form a spout so that particularly easy and accurate dosing is possible. In particular, the side-gusset bag can be emptied in a particularly controlled manner by a user inclining the side-gusset bag, thereby especially enabling accurate removal of partial quantities, and then the remaining contents is protected by the reclosable fastener.

With respect to the arrangement and configuration of the reclosable fastener, reference can be made to the embodiments known from the prior art, in particular to configurations according to the above-cited US and EP patent publications that are incorporated herewith by reference.

For example, the side-gusset bag can have a filling volume between 1 l and 50 l, in particular between 2 l and 30 l. The side-gusset bag is particularly suitable for accommodating bulk materials such as pelletized animal feed, washing agent, cat litter, salt and powdery or granular construction materials.

In order to ensure reliable closure, usually, an upper weld tightly seals the side-gusset bag above the reclosable fastener before the first opening. For a first opening, at least a portion of the bag upper end formed by the upper weld is torn off in order to expose the underlying reclosable fastener and to enable the spout to be folded out and resealed.

The reclosable fastener comprises at least one reclosable fastener strip that preferably runs exactly in the transverse bag direction, parallel to and below the upper panel edges. It is in principle possible that the reclosable fastener has a plurality of separate reclosable fastener strips that can be interlocked with one another. However, according to a preferred configuration of the invention the reclosable fastener has a single continuous reclosable fastener strip that can be interlocked with itself. In production, such a reclosable fastener strip can be fixed in place in a particularly easy manner, and the reclosable fastener strip can then be arranged in the desired position on the side gusset panel simply by folding.

With respect to the specific configuration of the reclosable fastener strip, various possibilities arise within the context of the invention. Although a reclosable fastener strip on the basis of adhesive is not excluded, it is preferred to use mechanical interlocking. In order to achieve a mechanical interlock, the reclosable fastener strip can have either continuous and complementary closure configurations or a plurality of individual complementary closure elements that can be interlocked or interfitted with one another. For example, grooves, projections and strips bent like a hook that can be interlocked with one another or with themselves can be considered as continuous closure configurations. Adequate structures can be extruded, for example, and the closure configurations usually are arranged on a thermally weldable support section or are extruded integrally with the thermally weldable support section.

Individual closure elements that can be interlocked with one another can be provided, for example, in the form of velcro-type hooks, mushroom heads or the like. Individual interlockable closure elements have the advantage that secure interlocking is also possible in case of a vertical offset. The individual mushroom heads or velcro-type hooks are usually movable in such a manner that upon external pressure they can penetrate into associated cavities and can then interlock there with similar closure elements. Individual closure element that can interlock with one another also provide the advantage that although contaminations prevent a connection at one spot, the contamination cannot cause the entire reclosable fastener strip to be easily pulled open.

According to a preferred configuration of the invention, the face panels and the side gusset panels are formed from a bag film, in particular a uniform bag film, and the face panels and the side gusset panels can be folded from a uniform material web, as described above. The bag film usually has at least one thermally weldable inner layer and one outer layer with the inner layer forming in the finished bag the inner surface thereof and the outer surface forms its outer surface. Thus, the inner layer forms the inner surface of the side-gusset bag while the outer layer forms the outer surface.

Advantageously, the inner layer is very suitable for welding in order to seal the bag circumferentially, to be able to form longitudinal and transverse welds and to be able to attach further elements, such as the reclosable fastener, by welding. Besides polyolefins such as polyethylene (PE) and polypropylene (PP) and polyolefin copolymers, various biodegradable plastics such as polyactide acid (PLA), polybutyrate (PBAT) and polybutylene succinate (PBS) are also possible as a thermally weldable material for the inner layer.

In comparison to the inner layer, the outer layer is less suitable for welding, and the outer layer can have a higher melting or softening temperature. During welding of the bag film, although the inner layer is melted—optionally through the outer layer—the outer layer is nevertheless not excessively deformed or does not lose its structure. The outer layer can in particular be formed from polyester. Furthermore, reducing the tendency to melt during welding can also be achieved by orienting the outer layer. Thus, oriented polyethylene terephthalate (OPET), oriented polyamide (OPA), oriented polypropylene (OPP) and oriented polyactide acid (OPLA) can also be considered for the outer layer. Moreover, the outer layer can also be formed from a cellulose film.

According to a preferred configuration of the invention, a laminated film is used as a bag film, and a first film is connected to the inner layer and at least one second film is connected to the outer layer by means of an adhesive. For example, suitable is a two-component adhesive based on polyurethane (2K-PUR). Eventually, further intermediate layers can also be provided to increase the barrier effect, for example. A film layer from ethylene vinyl alcohol copolymer (EVOH), a thin metal film or a metallized film layer can be provided as a barrier, for example.

In the case of a laminated film, an inner imprint is preferably also provided, the imprint being applied to one of the connecting surfaces of the films to be connected before laminating.

As already explained above, the side-gusset bag is advantageously produced using a longitudinal method, and the material web of the bag film is first formed into a side-gusset tube from which then individual side-gusset bags are cut.

Correspondingly, according to a preferred configuration of the invention it is provided that at least a portion of the side edges formed between the side gusset panels and the face panels is formed as folding edges. In order to be able in production to close the side-gusset tube laterally, a longitudinal welding is preferably carried out. It can overlap with one of the side edges so that this side edge is not formed as a folding edge. Moreover, the edges of the material web can also be connected at one of the front surfaces by a longitudinal seam.

Also, if at least a portion of the side edges are formed as folding edges, producing longitudinal welds at the side edges can be useful in order to increase geometrical stability and dimensional stability of the side-gusset bag. After forming the longitudinal welds, an outer edge can also be cut off to improve the visual appearance.

An upper edge of the bag above the reclosable fastener usually is closed by a transverse weld. As part of such a configuration, the side gusset panels extend from the flat bottom up to the transverse weld at the upper edge of the bag, thus over the entire vertical length of the side-gusset bag, as viewed in the longitudinal bag direction. Further measures for shortening the side gusset panel are then not necessary.

In particular in the case of a large filling volume and/or a high filling weight, the side-gusset bag can be provided with a handle. For this purpose, the handle can be stamped in at a sealed region of the bag upper, as known from above-cited EP 2 032 454. However, according to a preferred configuration of the invention, the second side gusset panel has a handle that then is located opposite the reclosable fastener. Suitable configurations of handles are known from above-cited US 2011/0033133. While the reclosable fastener is advantageously close to the upper end of the side-gusset bag, the handle can be arranged approximately centered with respect to the longitudinal bag direction or slightly offset toward the flat bottom of the side-gusset bag so that the weight of the side-gusset bag can easily be controlled even during pouring through the open spout.

The flat bottom that, according to the invention, is provided by a separate film section, usually has a thermally weldable inner layer and an outer layer, as previously described, and the flat bottom can also be formed from the previously described bag film. The flat bottom usually has a rectangular shape, and the length and width of the film section respectively correspond to the width of the face panels and the rectified width of the side gusset panels.

Due to the flat bottom, the side-gusset bag can be stood up. This is an advantage when filling, transporting, storing and handling the side-gusset bag. In contrast to the tube section model that is simply folded over for forming a standing bottom, this results also in material savings in addition to improved handling, because it is not necessary to fit a plurality of film layers on top of one another.

In the method according to the invention, a modification is based on a longitudinal method and is that, for each film bag, cuts are created that cut in transverse direction through a first face panel formed from the material web and through the adjoining side gusset panels. Advantageously, the cuts can be formed when the material web is still flat, and, however, tearing apart during folding has then to be prevented and the material web has to be conveyed with appropriate caution. It would principally also be conceivable to simply provide a weakening line or perforation on the material web that is then further torn apart afterward.

According to a preferred configuration of the method, reclosable fastener strips running transverse to the production direction are arranged on the material web uniformly longitudinally spaced apart and also uniformly spaced from the cuts. These reclosable fastener strips, after formation of the side-gusset bag, extend on one of the side gusset panels and over a portion of the respective front and back face panels. This then, within the method according to the invention, forms the previously described side-gusset bag having a reclosable fastener on the first side gusset panel. The reclosable fastener strip advantageously extends on the face panels over a width that corresponds to half the width of the associated side gusset panel. In such a configuration, only a connection of the two subpanels of each of the side gusset panel is carried out to the respective front face panel. If the reclosable fastener extends beyond the region of the of the side gusset panel, the front and back face panels can also be connected to one another in certain sections.

However, the reclosable fastener strip extends in all cases at least over a portion of the face panels.

According to another aspect, it is also possible with the method to attach handles that advantageously are arranged on the side gusset panel that is opposite the reclosable fastener strips.

Usually, exactly one handle and exactly one reclosable fastener strip are attached to each bag. While the reclosable fastener strips can be attached on the inner layer of the bag film, the handle has also to be accessible from the outside. Various suitable handle constellations are known from above cited US 2011/0033133.

In order to close the side-gusset bag along the edge a thermal weld can be provided, and such a thermal weld is preferably formed at one of the side edges. Basically, all side edges can be provided with a thermal weld in order to improve the stability of and stiffen the formed side-gusset bags, making it stand on end stably. When the material web is welded at a side edge to form a tube that is closed laterally, the projecting longitudinal edges of the bag web can be trimmed off.

The first face panel is preferably folded over at a folding line that is spaced apart from the cut in such a manner that the spacing between the folding line and the cut corresponds approximately to half the rectified width of the side gusset panel, that is the transverse width of one of its two identical subpanels. The face panel is then folded over as far as possible, as a result of which the exposed side gusset panel extends from a centered fold line outward at an oblique angle of 45°.

The separate film section for forming a flat bottom for each side-gusset bag is advantageously attached to the face panels and the side gusset panels by thermal welds. The welding at the side gusset panels can be readily carried out on the flat-lying side-gusset tube. This applies to the connection of the separate film section to the exposed second face panel. In order to avoid undesirable welding when connecting the separate film section to the upward-folded edge of the first face panel within the side-gusset tube, the corresponding creation of a transverse weld is preferably carried out in the lifted state.

BRIEF DESCRIPTION OF THE DRAWING

The above and other objects, features, and advantages will become more readily apparent from the following description, reference being made to the accompanying drawing in which:

FIG. 3A to 3F show method steps of making the side-gusset bag shown in FIGS. 1 and 2.

SPECIFIC DESCRIPTION OF THE INVENTION

Figure 1:
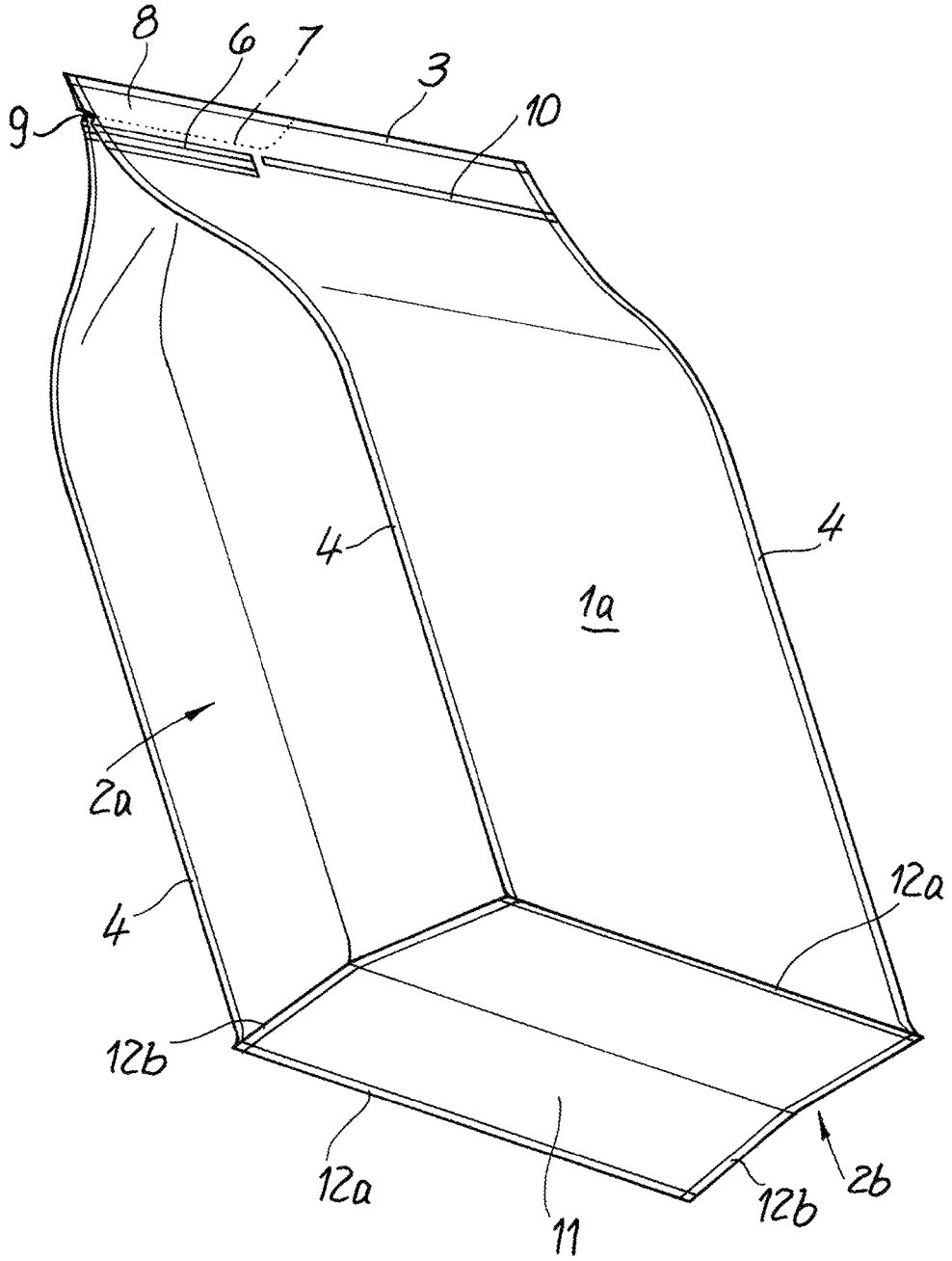
FIG. 1 is a perspective view from below of a side-gusset valve according to the invention.

As seen in FIG. 1, a side-gusset bag according to the invention has two opposite and substantially identical and rectangular face panels 1*a* and 1*b*, a first side gusset panel 2*a* and a second side gusset panel 2*b* each having a center fold and formed by a pair of identical rectangular subpanels. The side gusset panels 2*a* and 2*b* extend opposite to one another in a longitudinal direction 1 and are each connected to longitudinal outer edges of the face panels 1*a* and 1*b* so as to connect them to one another.

Figure 2:
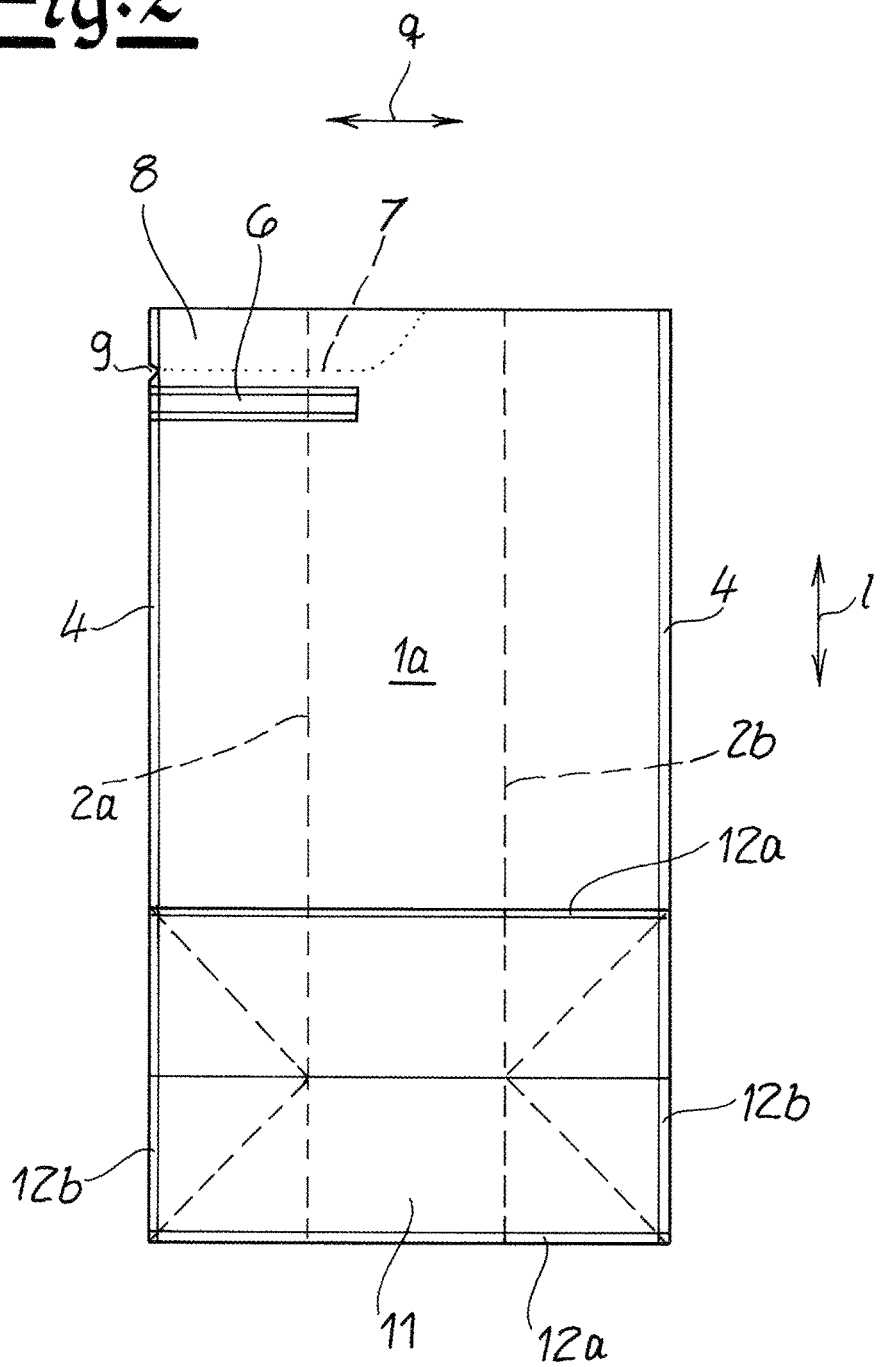
FIG. 2 is a front view of the bag when folded flat.

While FIG. 1 shows a filled side-gusset bag that is closed in a transverse bag direction q by an upper weld 3, FIG. 2 shows a side-gusset bag that is provided as a pre-made bag in a flat-lying state for a subsequent filling operation. In order to arrive from FIG. 2 to the filled bag according to FIG. 1, the pre-made flat-lying bag is filled at at an upper edge that initially is not closed, and is closed after filling by an upper thermal weld 3. Side edges between the face panels 1*a* and 1*b* and the side gusset panels 2*a* and 2*b* are reinforced by the longitudinal thermal welds 4.

FIGS. 1 and 2 show that the bag has a reclosable fastener with a reclosable fastener strip 6. The reclosable fastener strip 6 is provided at the first side gusset panel 2*a* and extends over the two subpanels of the first side gusset panel 2*a* inserted between the face panels 1*a* and 1*b* and extending the full length of the face panels 1*a* and 1*b*. In the illustrated embodiment, the reclosable fastener strip 6 extends on the face panels 1*a* and 1*b* beyond the first side gusset panel 2*a* so that there, in a region adjoining the first side gusset panel 2*a*, the front and back face panels 1*a* and 1*b* can also be directly connected to one another. In contrast, at the first side gusset panel 2*a*, the two subpanels of the corresponding subpanels of the side gusset panel 2*a* are each connected to a respective one of the front and back face panels 1*a* and 1*b*.

In order to open the side-gusset bag for the first time, a weakening line 7 above the strip 6 allows a corner section 8 to be torn off above the reclosable fastener strip 6. The weakening line 7 can be formed, for example, by stamping, a perforation or a laser, and these various measures can also be combined with one another. Also, a transversely outwardly open notch 9 is provided at the end of the tear line 7 to aid in starting the tear.

In order to enable closure of the side-gusset bag after first opening, a transverse weld 10 extends from the end of the reclosable fastener strip 6 to the opposite bag edge and parallel to the upper bag edge.

After first opening, the first side gusset panel 2*a* can be folded outward by opening the reclosable fastener formed by the reclosable fastener strip 6, thereby forming a spout, and can be inserted again between the front and back face panels 1*a* and 1*b* for reclosing.

According to the invention, the side-gusset bag has a flat bottom or floor panel that is formed from a separate section 11 of film section. The film section 11 is connected to the lower edges of the face panels 1*a* and 1*b* and the side gusset panels 2*a* and 2*b* by thermal welds 12*a* and 12*b*. While the flat bottom is particularly advantageous during filling, transporting, storing and handling and enables secure placement of the side-gusset bag in an upright position, the filling material can be easily removed via the reclosable fastener and removing accurate partial quantities is also possible due to the shape of the spout.

Depending on the filling weight, the side-gusset bag can also be provided with a handle that is not illustrated that, for practical reasons, is provided on the second side gusset panel 2*b* opposite the reclosable fastener 6.

The reclosable fastener strip 6 can have continuous closure configurations in the form of grooves or projections or can have a plurality of individual closure elements that can be interlocked with one another, wherein such interlockable closure elements can have the shape of mushroom heads or velcro-type hooks.

A preferred method of making the side-gusset bag of FIGS. 1 and 2 is shown in FIGS. 3A to 3F.

The method includes feeding a material web 13 of a bag film 13 a production direction p hose 9 orientation corresponds to the longitudinal bag direction 1. The corresponding method is therefore also designated as a longitudinal method.

Figure 3A:
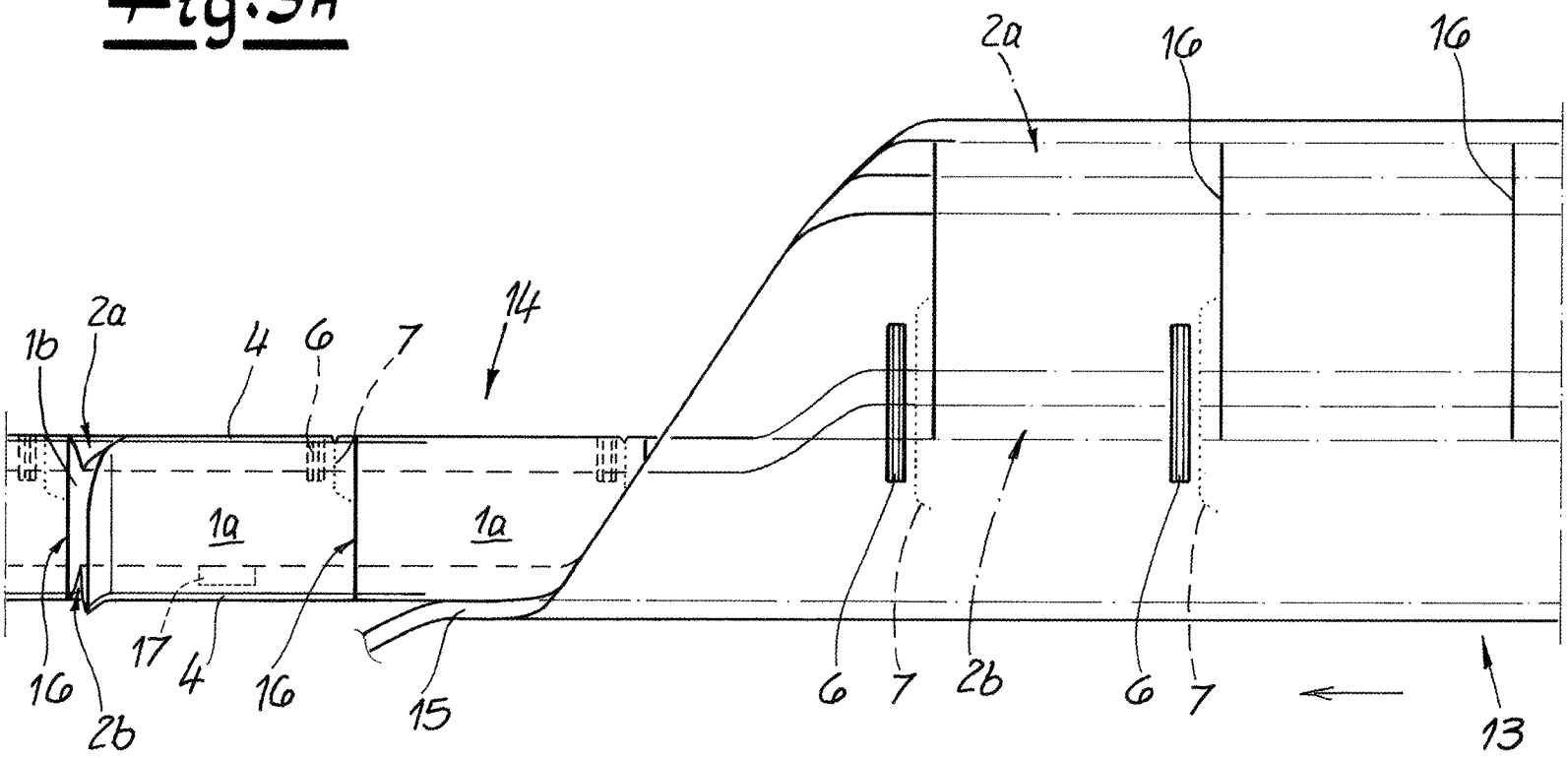
Figure 3B:
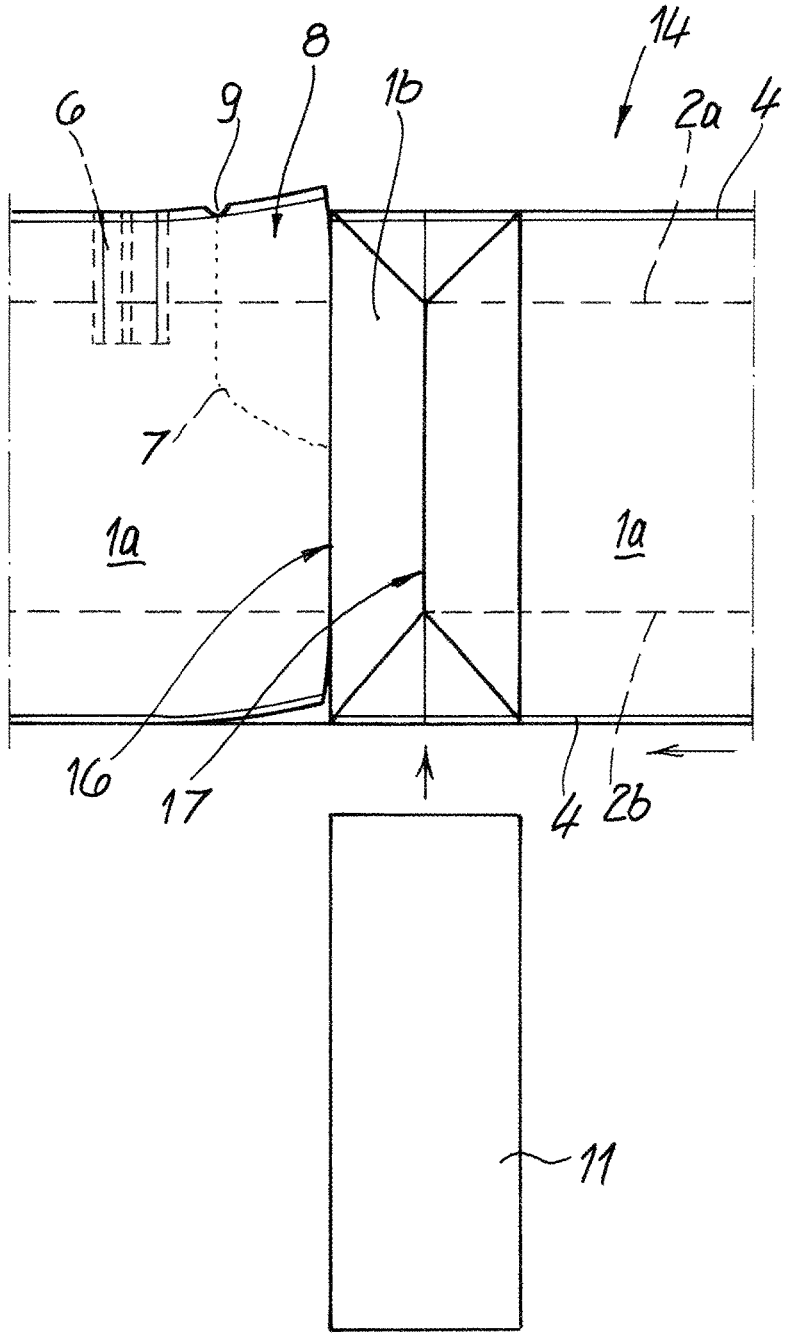

According to FIG. 3A, the bag film 13 is folded in a manner known per se so as to form a side-gusset tube 14 that has a row of the first face panels 1*a*, a row of the second face panels 1*b* and two rows of the side gusset panels 2*a* and 2*b* connecting the face panels 1*a* and 1*b*. FIG. 3A shows the fold lines. In addition a handle 17 glued to one of the second panels 2*b* is shown.

Outer edges 15 of the bag film 13 are project laterally to one side and are trimmed off after formation of the side-gusset tube 14.

According to FIG. 3A, a transversely extending cut 16 is created before folding the bag film 13 for each side-gusset bag in such a manner that the cut 16 extends in the subsequently formed side-gusset bag 14 over the two side-gussets 2*a* and 2*b* and the first face panel 1*a* that is provided between the side-gussets 2*a* and 2*b*, but not into the edge regions that are subsequently trimmed off. As will be explained in detail below, the individual side-gusset bags are separated from the side-gusset tube 14 at the cuts 16 that are provided for forming a flat bottom.

The bag film 13 is formed from at least two layers and comprises a thermally weldable inner layer made of polyolefin, in particular polyethylene, and an outer layer made of polyester, in particular PET. The film section 11 can be formed from an identical laminate. According to FIG. 3A, the thermally weldable inner layer of the bag film 13 fed in a flat state is initially exposed so that a transversely extending reclosable fastener strip 6 can also be welded thereon for each side-gusset bag. Adjacent the reclosable fastener strip 6, the weakening line 7 is already created in the flat bag film 13 so that the upper corner section 8 of the finished side-gusset bag can subsequently be detached for exposing the reclosable fastener strip 6 when opening for the first time.

Since the cuts 16 extend over the first face panel 1*a* and the two side gusset panels 2*a* and 2*b*, the first face panel 1*a* can be lifted, for which purpose grippers or vacuum pads can be used, for example.

FIG. 3A also shows that it is possible to make longitudinal edge-stiffening welds 4 during formation of the side-gusset tube 14. When the first face panel 1*a* on top is now partially folded over at the cuts 16, the two side gusset panels 2*a* and 2*b* and the second face panel 1*b* are partially exposed (see FIG. 3B), as a result of which the side gusset panels 2*a* and 2*b* extend there from a fold line 17 and run outward at an angle of 45°. The separate film section 11 that, according to FIG. 3B, can in particular be fed from the side, is placed onto the base region that is folded open in this manner along the fold line 17.

Figure 3C:
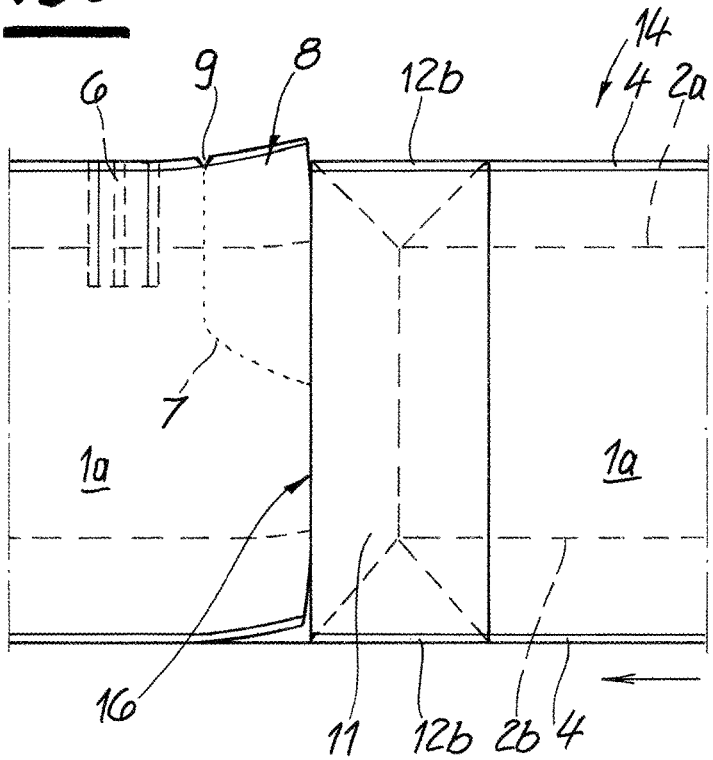

According to FIG. 3C, this separately fed film section 11 is connected to the upward-folded side gusset panels by thermal welds 12*b* with the side-gusset tube 14 lying flat.

Figure 3D:
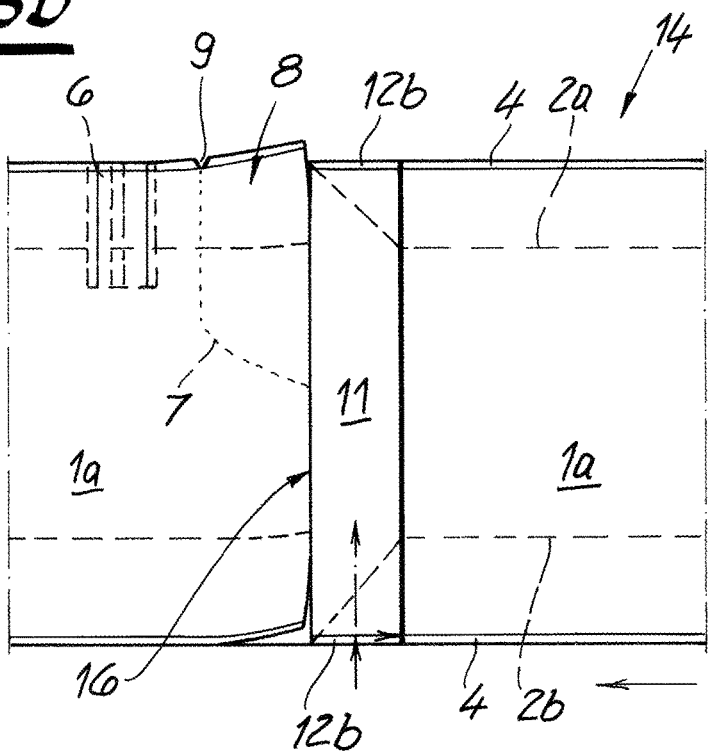

In order to avoid undesirable creation of a thermal weld within the side-gusset tube 14 when connecting the separate film section 11 to the first face panel 1*a*, as shown in FIG. 3D, the folded section of the first face panel 1*a* is set upright and while upright is connected to the separate film section 11 along a thermal weld 12*a* (FIG. 3E).

However, connecting the separate film section to the second face panel 1 can also be carried out beforehand or afterward without any problems. FIG. 3F shows as an example the creation of this second thermal weld 12*a* immediately before cutting off the individual side-gusset bags. It is also possible to form both thermal welds 12*a* together when the separate film section 11 is folded down again (FIG. 3D), because then the connections of the separate film section 11 to the first face panel 1*a* and the second face panel 1*b* lie on top of one another at the lower bag edge.

We claim:

1. A method of making a bag having:

identically shaped front and back face panels having upright longitudinally extending side edges and transversely extending upper and lower edges;

identically shaped first and second side gusset panels each having transversely extending upper and lower edges and upright longitudinal outer edges connected to the longitudinal side edges of the face panels; and a separate generally rectangular floor panel having outer edges joined to the lower edges of the face panels and of the side gusset panels, the method comprising the steps of:

longitudinally advancing a flat longitudinally elongated bag film having longitudinal film edges and two longitudinally extending halves in a longitudinally extending production direction;

forming in the flat advancing bag film a succession of longitudinally spaced through cuts each extending transversely across more than one of the longitudinally extending halves of the bag film from a point spaced transversely inward of one of the longitudinal film edges and each having a length equal to a transverse width of the front panel plus twice a rectified transverse width of one of the side gusset panels, whereby the bag film remains uncut and uninterrupted along both longitudinal film edges and each through cut only extends transversely partially into the other of the longitudinally extending halves, the through cuts dividing the one longitudinal half into a longitudinal succession of the front face panels while the other of the longitudinally extending halves that will form the back panels is continuous;

folding the cut and advancing bag film along longitudinal fold lines with the one longitudinally extending half on top and with the longitudinal film edges lying atop one another to form a bag tube having a longitudinal succession of the back panels, a longitudinal succession of the front panels each lying atop a respective one of the back panels and separated by the through cuts, and two longitudinal successions of side gusset panels folded between the longitudinal side edges of the face panels, extending a full longitudinal length of the respective front and back panels, and separated by the through cuts;

lifting the lower edge of each of the front panels of the folded bag film at the respective through cut and fitting between each of the lifted lower edges and the lower edge of the respective back panel a respective rectangular film section to form the floor panel;

joining the rectangular film sections of the folded bag film to the lower edges of the front and back panels and of the side gusset panels;

trimming off the uncut longitudinal film edges of the bag film joined to the rectangular film sections; and separating the cut, folded, and welded bag film into bags by transversely severing the back panels from each other at the through cuts.

2. The method defined in claim 1, further comprising the step of:

applying to the film at locations that in the separated bags lie adjacent the upper edges the reclosable fastener strips extending transversely along the first gusset panels and inward along each of the face panels from the first gusset panels along part of a transverse width of the face panels, whereby opening of a fastener formed by the fastener strips and folding out of the first gusset panel forms a spout on the bag.

3. The method defined in claim 2, wherein the fastener strips each includes a pair of contiguous strips releasably joinable to each other and either of complementary uniform cross section or having interengaging rows of complementary formations.

4. The method defined in claim 1, further comprising the step of:

mounting handles on each of the second side gusset panels.

5. The method defined in claim 1, wherein when each front panel is lifted at the lower edge it is folded back to form a flap having a width equal to half of a rectified width of a one of the side gusset panels.

6. The method defined in claim 1, further comprising the step of:

thermally welding the lower edges of the face panels and side gusset panels to the outer edges of the floor panel.

7. The method defined in claim 1, further comprising the step of:

forming a longitudinal thickening weld along the joined longitudinal side edges of the face panels and the side gusset panels to stiffen the face panels and side gusset panels.

8. The method defined in claim 1, wherein the panels are all substantially rectangular and formed of a synthetic-resin film.

9. The method defined in claim 8, wherein each panel is formed as a laminate with a heat-weldable inner layer of polyolefin and an outer layer of polyester, the bag film being folded such that the heat-weldable inner layer forms inner surfaces of the bags.

10. The method defined in claim 1, further comprising the step of:

welding together the upper edges of the face panels and gusset panels to upwardly close the bag at a top weld.

11. The method defined in claim 10, wherein the side gusset panels extend a full longitudinal length of the face panels from the top weld to the floor panel.

* * * * *